United States Patent [19]

Newsom

[11] Patent Number: 4,821,026

[45] Date of Patent: Apr. 11, 1989

[54] VISUAL AND AUDIBLE ALARM DEVICE

[76] Inventor: Larry T. Newsom, 10002 Old Providence Way, Apt. D, Cockeysville, Md. 21030

[21] Appl. No.: 152,851

[22] Filed: Feb. 5, 1988

[51] Int. Cl.[4] ..... G08B 7/00

[52] U.S. Cl. ..... 340/574; 116/280; 116/DIG. 44; 340/693

[58] Field of Search ..... 340/574, 693; 116/DIG. 44, 280, 209, 173; 446/247, 242; 350/98, 99

[56] References Cited

U.S. PATENT DOCUMENTS

| | | | |
|---|---|---|---|
| 2,626,586 | 1/1953 | Mendes | 116/DIG. 44 |
| 2,782,748 | 2/1957 | Zegarowitz | 116/112 |
| 3,038,381 | 6/1962 | Jones | 350/98 |
| 3,439,446 | 4/1969 | Alonso | 446/247 |
| 3,825,833 | 7/1974 | Bogue et al. | 340/574 |
| 4,055,840 | 10/1977 | Uchytil et al. | 116/63 P |
| 4,404,549 | 9/1983 | Berg | 340/574 |
| 4,427,724 | 1/1984 | Stark et al. | 116/173 |

*Primary Examiner*—Glen R. Swann, III

*Attorney, Agent, or Firm*—Leonard Bloom

[57] ABSTRACT

A personal visual and audible alarm device for fires and other emergencies id disclosed. The device has an audio alarm in the form of a beeper and a visual alarm in the form of a plurality of streamers. An internal electrical power supply source is disposed in the housing of the device for continuously energizing the audio alarm. An on/off switch is secured to the housing of the device extending outwardly therefrom, providing manual access thereto. The on/off switch is electrically connected between the power supply source and the audio alarm. This on/off switch permits the audio alarm to be selectively, manually activated and deactivated. This device aids searchers in locating individuals who may be trapped in fires or other emergencies.

21 Claims, 3 Drawing Sheets

VISUAL AND AUDIBLE ALARM DEVICE

FIELD OF THE INVENTION

The present invention relates to visual and audible alarm devices for use in locating individuals in emergencies and, in particular to personal and portable visual and audible alarm devices for locating individuals who are trapped in fires or other emergencies.

BACKGROUND OF THE INVENTION

There are several devices, of which I am aware, which provide audio, as well as visual, signals and alarms in the event of fire. Normally, such devices are fixed in place in those portions of a building where fire or smoke is likely to occur. An example of such a device which provides an audio alarm is described in U.S. Pat. No. 2,626,586 issued to Mendes. While these devices are quite useful for warning individuals of the presence of a fire, they are not useful for aiding individuals, such as firemen, in locating persons who may be trapped in the fire.

I am also aware of the existence of personal alarm devices, wherein visual and audio alarms are combined in a single device for, i.e., warding off attackers. An example of such a device is described in U.S. Pat. No. 2,782,748 issued to Zegarowitz. However, to the best of my knowledge no one has provided a personal alarm device which has both audio and visual stimuli that would aid in the location of victims who may be trapped in a fire.

The audio alarms of Mendes and Zegarowitz, while being suitable for their purpose, are not readily adaptable for use in aiding in the location of trapped individuals. The audio alarms of both Mendes and Zegarowitz are activated by the release of compressed air or gas from a cartridge. Such cartridges are not capable of holding sufficient quantities of air or gas to maintain a prolonged audio signal which sounds for a sufficient period of time to permit location of an individual in a fire. If the cartridges were made larger, then those devices would lose whatever portability they had.

The visual alarm of Zegarowitz, while being suitable for its purpose is also not readily useful for aiding in the location of trapped individuals. The visual alarm of Zegarowitz is a lamp which, during daylight hours, would not be readily visible. Also such a device would do little if the person were trapped on upper floors of a burning building.

Accordingly, it can be seen that there remains a need for a simple, lightweight and portable personal alarm device, which has both audio and visual alarms, both of which are readily detectable, for aiding in the location of individuals who are trapped in fires, or in other emergencies.

SUMMARY OF THE INVENTION

Accordingly, it is an object of the present invention to provide a personal alarm device which has both audio and visual alarms each of which aid in the location of individuals who are trapped in a fire or who otherwise have an emergency.

It is another object of the present invention to provide such a personal alarm device which has both a sustained audio as well as visual alarm.

It is still another object of the present invention to provide such a personal alarm which is simple, lightweight and which requires only a single power source.

It is a still further object of the present invention to provide such a personal alarm which has both audio and visual stimuli which may be detected during the daylight hours, as well as at night.

In accordance with the teachings of the present invention there is provided a personal visual and audio alarm device for use during fires and/or other emergencies. This device includes a substantially hollow alarm housing having an upper end and a lower end. An internal electrical power supply source is disposed in the alarm housing. An audio alarm is secured to the housing. This audio alarm is electrically connected to the internal power supply source. In this manner, the internal power supply source provides power for activating the audio alarm. An on/off switch is secured to the housing, extending outwardly therefrom. Positioned thusly, manual access is provided to the switch. This on/off switch is electrically connected between the internal power supply and the audio alarm for selectively, manually connecting and disconnecting the internal power supply source and the audio alarm. In this fashion, the audio alarm is selectively, manually activated and deactivated. Finally, a plurality of streamers are secured to the alarm housing and extending therefrom, providing a visual alarm.

It is preferred that the internal electrical power supply source be an internal electrical battery. It is also preferred that a battery holder be disposed in the housing for removably receiving and securing the battery therein, whereby the internal electrical battery is removably secured in the housing. Finally, it is further preferred that the alarm housing has a door that is selectively openable providing internal access to the housing including the battery positioned therein. The door is also selectively closable, preventing internal access to the housing including the battery positioned therein.

In a preferred embodiment, the alarm device also includes a plug having one portion electrically connected between the switch and the audio alarm and a second, opposite portion adapted for being connected to an auxiliary electrical power supply source. This plug permits an auxiliary electrical power supply source to be provided for activating the audio alarm.

In another preferred embodiment, the alarm device also includes the on/off switch as a resilient push button on/off switch carried by the housing and extending outwardly therefrom. This switch is constantly resiliently biased in an upward direction. In this fashion, the switch is moved into its off position, deactivating the alarm. Further, manual downward force on the button overcomes the upward resilient biasing force, moving the switch into its on position, activating the alarm.

Preferably, the on/off switch is secured to the housing within an internally threaded aperture formed therein; and the on/off switch is externally threaded for threadably engaging and cooperating with the threaded aperture. In this fashion, the switch is threadably secured to the housing, extending outwardly therefrom and providing manual access thereto.

These and other objects of the present invention will become apparent from a reading of the following specification, taken in conjunction with the enclosed drawings.

DESCRIPTION OF PREFERRED EMBODIMENTS

Figure 1:
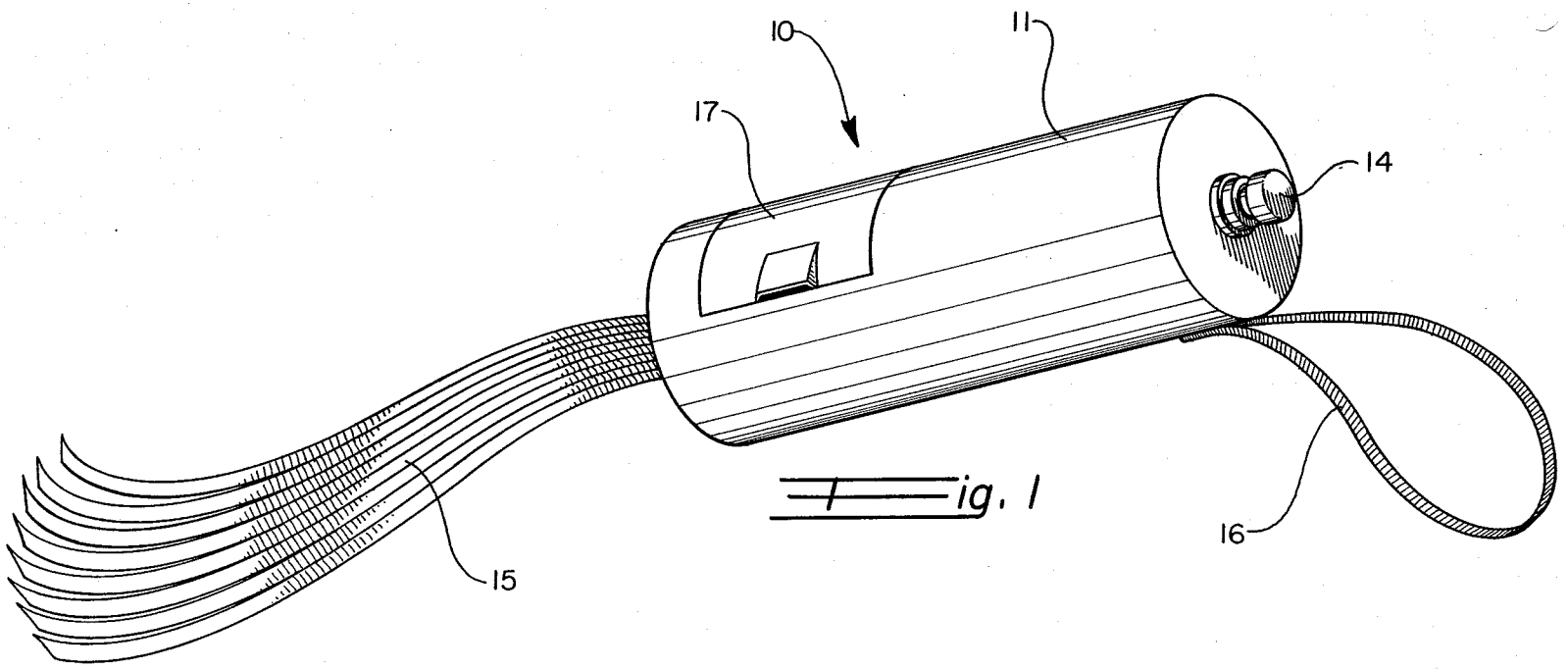
FIG. 1 is a perspective view of the personal visual and audible alarm device of the present invention.
Figure 2:
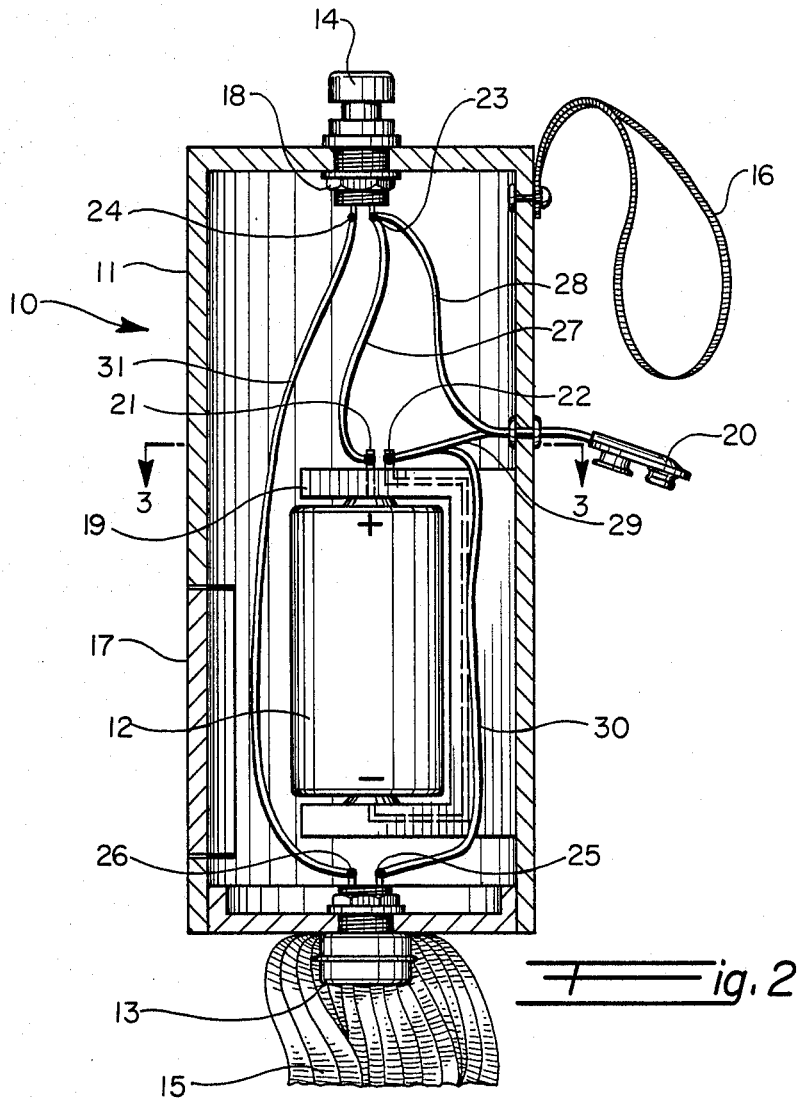
FIG. 2 is a longitudinal sectional view of the alarm device of FIG. 1.
Figure 3:
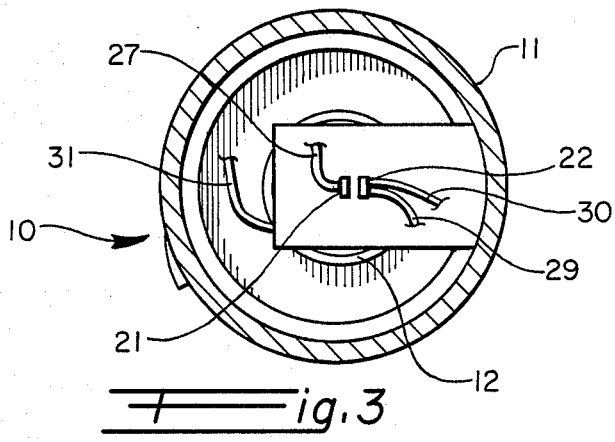
FIG. 3 is a cross-sectional view taken along lines 3—3 of FIG. 2.

With reference now to FIGS. 1-3, the device 10 includes a substantially hollow alarm housing 11 which, preferably, is substantially cylindrical in shape and which has an upper end and a lower end. It is further preferred that housing 11 be fabricated as a hollow plastic casing. It is to be understood, however, that any suitable material such as lightweight aluminum or metal alloy can suffice. Indeed, it is contemplated herein that fabrication of the housing 11 from a metal or metal alloy would render the device more resistant to heat, a feature that would be advantageous in the event of fire.

Disposed in the housing 11 is an internal electrical power supply source 12 (FIGS. 2 and 3) which provides electrical power for the audio alarm 13, as shall be hereinafter discussed. Preferably, source 12 is a common electrical battery 12.

An audio alarm 13 is secured to the housing 11 at, preferably, the lower end thereof by suitable means. As shall be discussed at greater length herein, this audio alarm 13 is electrically connected to the internal power supply source 12, such that the source 12 provides electrical power for activating the audio alarm 13. Preferably, the audio alarm 13 is in the form of an audio beeper, although any suitable loud audio sound-producing device will suffice.

An on/off switch 14 is secured to the upper end of the housing 11 by any suitable means. Switch 14 is carried by the housing 11 so as to extend outwardly therefrom, providing manual access thereto. As shall also be discussed at greater length herein, this switch 14 is electrically connected between the internal power supply source 12 and the audio alarm 13. Connected and positioned thusly, the power supply source 12 and the audio alarm 13 may be selectively and manually connected and disconnected to each other for activating and deactivating the alarm 13.

A plurality of streamers 15 are secured to the lower end of the alarm housing 11, extending downwardly therefrom. These streamers 15 provide a visual alarm that can be seen even in daylight (even when sunlight would otherwise mask or obstruct a light beam). Preferably, streamers 15 are strips fabricated from a high visibility, reflective material. It is further contemplated that streamers 15 may also be fabricated from a material which "glows in the dark". It is further preferred that streamers 15 be fabricated from a plastic material, although it is to be understood that any suitable material may be utilized.

It is also preferred that the streamers 15 be secured to the housing 11, surrounding the audio alarm 13.

A lanyard cord 16 is secured to the housing 11. Lanyard cord 16 provides a handle for manually holding the device. Although it may be formed from any suitable material (such as metal), it is contemplated herein that lanyard cord 16 will be fabricated by a insulative, non-conducting material such as rubber or nylon. In this fashion, heat from (for example a fire) will not make the cord 16 too hot to be manually held.

Finally, the alarm housing 11 also has a door 17 formed therein. Door 17 is selectively, manually openable and closable for, respectively, providing internal access to the inner workings of the housing 11 (including the battery 12 positioned therein) and preventing internal access to the inner workings of the housing 11 (including the battery 12 positioned therein). If desired, door 17 can also be provided with a lock.

Referring primarily now to FIGS. 2 and 3, the on/off switch 14 is seen to be a resilient push button on/off switch. Switch 14 is externally threaded for threadably engaging and cooperating with a threaded aperture which is formed in, preferably, the upper end of the housing 11. Finally, a securing nut 18 is threadably engaged on the threads of switch 14 in the internal portion of the housing 11, securing the switch 14 in place. The switch 14 is constantly biased in an upward direction, so that the switch 14 is moved upwardly into its off position, deactivating the audio alarm 13. Manual downward force on the button 14 overcomes the upward resilient biasing force, moving the switch 14 downwardly into its on position, activating the alarm 13.

While described thusly, it is noted herein that, if desired, switch 14 may alternatively be formed as a toggle switch, or any other suitable switch 14. However, in the context of the present invention, it has been found that this push button switch 14 is most desirable as providing for the easiest and simplest operation of the device for individuals of all ages.

The battery 12 is removably received and secured within a battery holder 19. Preferably, battery holder 19 is formed integrally with the housing 11 Holder 19 permits the battery 12 to be removably secured in the housing 11, so that the battery 12 may be changed when needed via the access provided by the door 17.

If desired, a plug 20 may be provided which permits the device 10 to receive electrical power from an auxiliary power source (not shown), such as an auxiliary battery. Plug 20 has one portion electrically connected (in a manner which shall be discussed at greater length herein) between the switch 14 and the audio alarm 13. The plug 20 also has a second opposite portion adapted for being connected to the auxiliary electrical power supply source.

Having thus described the device 10, we will now discuss how the various elements of the device 10 are electrically connected to one another.

The electrical power supply source 12 includes a positive terminal 21 and a negative terminal 22. The switch 14 also has a positive terminal (positive switch terminal) 23 and a negative terminal (negative switch terminal) 24. Finally, the audio alarm 13 has a positive terminal 25 and a negative terminal 26.

A positive terminal lead 27 and a first (positive) auxiliary power supply source lead 28, each has one end which is electrically connected to terminal 23 by any suitable means well known to those skilled in the art, such as by soldering. The second, opposite end of lead 28 is electrically connected to the plug 20. The second, opposite end of lead 27 is electrically connected to the positive terminal 21.

A second (negative) auxiliary power supply source lead 29 has one end which is electrically connected to the negative terminal 22 and a second end which is electrically connected to the plug 20.

A first power lead 30 is electrically secured, on one end thereof to the negative terminal 22 and, on a second, opposite end thereof to the positive terminal 25. A second power lead 31 is electrically secured at one end thereof to the negative terminal 24 and on the second, opposite end thereof to the negative terminal 26.

In each of the above cases, each of the leads may be electrically secured to the respective terminal (and plug) by any suitable means, such as soldering, which is well known to those skilled in the art.

In the above fashion, electrical power from either the battery 12 or an auxiliary power source, provides electrical power for energizing, activating and operating the audio alarm 13, so that the switch 14 is able to electrically connect and disconnect the battery 12 and the alarm 13, thereby activating and deactivating the alarm 13.

Figure 4:
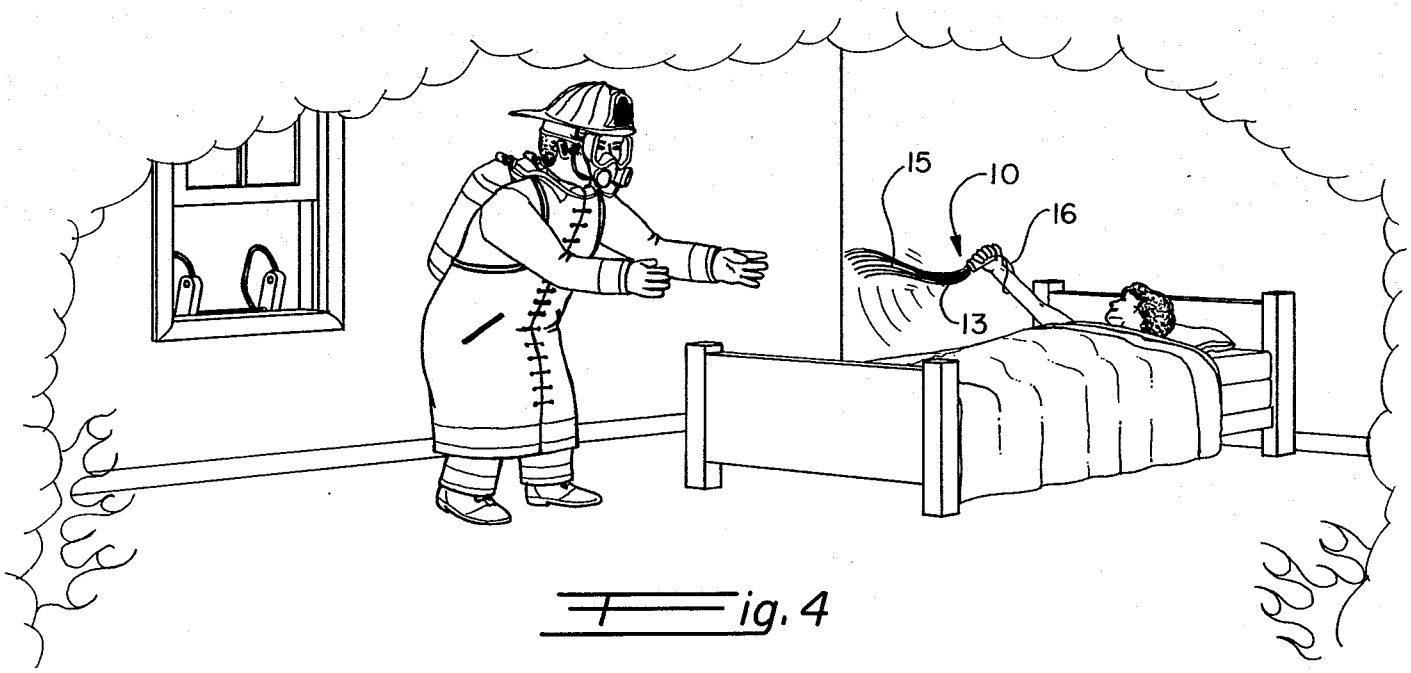
FIG. 4 illustrates the device being utilized by an individual to aid in a fireman locating said individual during an emergency such as a fire.

When formed as described above, the device 10 may be utilized by a person (such as a child) who is trapped in a fire (or during some other emergency) to aid in permitting searchers (such as a fireman) in locating them. (FIG. 4).

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. A personal visual and audible alarm device for fires and other emergencies, comprising:

a substantially hollow alarm housing having an upper end and a lower end;

an internal electrical power supply source disposed in the alarm housing;

an audio alarm secured to the housing, said audio alarm being electrically connected to the internal power supply source, such that the internal power supply source provides power for activating the audio alarm;

an on/off switch secured to the housing and extending outwardly therefrom and providing manual access thereto, said on/off switch being electrically connected between the internal power supply source and the audio alarm for selectively, manually connecting and disconnecting the internal power supply source and the audio alarm, whereby the audio alarm is selectively, manually activated and deactivated; and a plurality of streamers secured to the alarm housing and extending therefrom, whereby a visual alarm is provided.

2. The device of claim 1, further including a plug having one portion electrically connected between the switch and the audio alarm and a second, opposite portion adapted for being connected to an auxiliary electrical power supply source, such that an auxiliary electrical power supply source is provided for activating the audio alarm.

3. The device of claim 1, wherein the internal electrical power supply source is an internal electrical battery.

4. The device of claim 3, wherein the alarm device is further comprised of a battery holder disposed in the housing for removably receiving and securing the battery therein, whereby the internal electrical battery is removably secured in the housing.

5. The device of claim 3, wherein the alarm housing further has a door formed therein, said door being selectively openable providing internal access to the housing including the battery positioned therein; said door being selectively closable, preventing internal access to the housing including the battery positioned therein.

6. The device of claim 1, wherein the on/off switch is a resilient push button on/off switch carried by the housing and extending outwardly therefrom, said switch being constantly resiliently biased in an upward direction, whereby the switch is moved into its off position, deactivating the audio alarm, and further whereby manual downward force on the button overcomes the upward resilient biasing force, moving the switch into its on position, activating the alarm.

7. The device of claim 1, wherein the alarm housing is a hollow plastic casing.

8. The device of claim 1, wherein the streamers are strips of high visibility material.

9. The device of claim 1, wherein the on/off switch is secured to the upper end of the housing.

10. The device of claim 1, wherein the streamers are secured to the lower end of the housing.

11. The device of claim 1, wherein the audio alarm is an audio beeper.

12. The device of claim 1, further comprised of a lanyard cord secured to the housing providing a handle for manually holding the device.

13. The device of claim 1, wherein the streamers are secured to the housing surrounding the audio alarm.

14. The device of claim 1, wherein the on/off switch is secured to the housing by suitable means comprising:

the housing having an internally threaded aperture formed therein; and the on/off switch being externally threaded for threadably engaging and cooperating with the threaded aperture, whereby the switch is threadably secured to the housing, extending outwardly therefrom and providing manual access thereto.

15. A personal visual and audible alarm device for fires and other emergencies, comprising:

a substantially hollow alarm housing having an upper end and a lower end;

an internal electrical power supply source disposed in the alarm housing;

an audio alarm secured to the housing, said audio alarm being electrically connected to the internal power supply source, such that the internal power supply source provides power for activating the audio alarm;

an on/off switch secured to the housing and extending outwardly therefrom and providing manual access thereto, said on/off switch being electrically connected between the internal power supply source and the audio alarm for selectively, manually connecting and disconnecting the internal power supply source and the audio alarm, whereby the audio alarm is selectively, manually activated and deactivated;

a plurality of streamers secured to the alarm housing and extending therefrom, whereby a visual alarm is provided;

a lanyard cord secured to the housing providing a handle for manually holding the device, wherein the on/off switch is a resilient push button on/off switch carried by the housing and extending outwardly therefrom, said switch being constantly resiliently biased in an upward direction, whereby the switch is moved into its off position, deactivating the alarm, and further whereby manual downward force on the button overcomes the upward resilient biasing force, moving the switch into its on position, activating the alarm; and wherein the on/off switch is secured to the housing by suitable mans including the housing having an internally threaded aperture formed therein, and the on/off switch being externally threaded for threadably engaging and cooperating with the threaded aperture, whereby the switch is threadably secured to the housing, extending outwardly therefrom and providing manual access thereto.

16. The device of claim 15, further including a plug having one portion electrically connected between the switch and the audio alarm and a second, opposite portion adapted for being connected to an auxiliary electrical power supply source, such that an auxiliary electrical power supply source is provided for activating the audio alarm.

17. A personal visual and audible alarm device for fires and other emergencies, comprising:

a substantially hollow alarm housing having an upper end and a lower end;

an internal electrical power supply source disposed in the alarm housing;

an audio alarm secured to the housing, said audio alarm being electrically connected to the internal power supply source, such that the internal power supply source provides power for activating the audio alarm;

an on/off switch secured to the housing and extending outwardly therefrom and providing manual access thereto, said on/off switch being electrically connected between the internal power supply source and the audio alarm for selectively, manually connecting and disconnecting the internal power supply source and the audio alarm, whereby the audio alarm is selectively, manually activated and deactivated;

a plurality of streamers secured to the alarm housing and extending therefrom, whereby a visual alarm is provided;

wherein the internal electrical power supply source is an internal electrical battery;

a battery holder disposed in the housing for removably receiving and securing the battery therein, whereby the internal electrical battery is removably secured in the housing; and the alarm housing further has a door formed therein, said door being selectively openable providing internal access to the housing including the battery positioned therein, said door being selectively closable, preventing internal access to the housing including the battery positioned therein.

18. The device of claim 17, further comprised of a lanyard cord secured to the housing providing a handle for manually holding the device.

19. The device of claim 17, wherein the on/off switch is secured to the upper end of the housing and the streamers are secured to the lower end of the housing.

20. The device of claim 17, wherein the on/off switch is a resilient push button on/off switch carried by the housing and extending outwardly therefrom, said switch being constantly resiliently biased in an upward direction, whereby the switch is moved into its off position, deactivating the alarm, and further whereby manual downward force on the button overcomes the upward resilient biasing force, moving the switch into its on position, activating the alarm.

21. A personal audio and visual alarm device intended for alerting firemen or other rescuers in the event of an emergency, comprising a small portable substantially-cylindrical lightweight hollow housing intended to be grasped conveniently by the person's hand, the housing having a top end wall and a bottom end wall, an audible alarm carried by the bottom end wall of the housing, a removable battery in the housing, a switch carried by the top end wall of the housing, means for connecting the battery, switch and audible alarm in electrical series with each other, such that the battery is adapted to selectively energize the audible alarm, whereby when the housing is held in the person's hand, the person's thumb may conveniently engage the switch to turn the switch "on" and activate the audible alarm, and a plurality of highly-visible flexible streamers mounted on the housing and depending therefrom around the audible alarm on the bottom wall, whereby the person may shake the housing so that the streamers attract attention and recognition, thereby simultaneously providing both a visual and an audible alarm for substantially improved rescuing purposes.

* * * * *